United States Patent [19]

Henderson

[11] 3,934,874

[45] Jan. 27, 1976

[54] GOLF PUTTING AID

[76] Inventor: Frank D. Henderson, 32 Rolling Hill Drive, Chatham, N.J. 07928

[22] Filed: Apr. 7, 1975

[21] Appl. No.: 565,636

[52] U.S. Cl. ..... 273/35 A; 273/183 A; 273/186 C; 273/192

[51] Int. Cl.[2] ..... A63B 69/36

[58] Field of Search ..... 273/183, 186, 191, 192, 273/35, 190; 35/29 A

[56] References Cited

UNITED STATES PATENTS

| | | | |
|---|---|---|---|
| 2,929,631 | 3/1960 | Gillon | 273/183 E |
| 3,332,688 | 7/1967 | Gevertz | 273/192 X |
| 3,468,545 | 9/1969 | Anderson | 273/183 E |
| 3,604,712 | 9/1971 | Albro et al. | 273/191 R |
| 3,885,796 | 5/1975 | King | 273/192 X |

FOREIGN PATENTS OR APPLICATIONS

| | | | |
|---|---|---|---|
| 218,526 | 5/1957 | Australia | 273/192 |

*Primary Examiner*—George J. Marlo

[57] ABSTRACT

A longitudinal member, with a dimple to receive a golf ball, and an elongated indicia design, contains a reflective insert between a pair of parallel walls to indicate the position of the user's eyes relative to the ball and also includes a retaining bar supported by said walls to encourage a square, accelerating putting stroke.

4 Claims, 2 Drawing Figures

GOLF PUTTING AID

This invention relates to golf putting aids and, in particular, to an aid for encouraging proper putting address and stroke.

Golfers have long known that it is crucial to locate one's eyes directly above the ball in order to putt consistently well. Only in that way is the best angle for viewing the line obtained. That image will be sent to the mind's eye and will determine if the club will be aligned squarely throughout the stroke.

One problem has been determining the position of one's eyes in relation to the ball. The usual procedure is to ask an independent observer to note the placement of the eyes and then adjust. Yet the observer may be faulty in his judgment.

The other major problem is building a smooth, repeating stroke. Many golfers take a too long backswing, and then as the brain realizes that the swing is longer than the distance of the putt requires, they ease up on the downswing. This leads to a glancing blow rather than a solid hit. The clubhead must ideally pick up speed on the downswing, reaching a peak acceleration at impact. This insures a smooth rolling ball rather than one that spins off center.

H. Gevertz, in U.S. Pat. No. 3,332,688 issued July 25, 1967, described a putting aid utilizing a narrow channel and various markings to helf develop a grooved stroke. Kay Anderson attacked the problem of detecting head movement during the stroke with a lenticular device as described in his U.S. Pat. No. 3,468,545 dated 9/23/69. Similiarly, J. W. Gillon in U.S. Pat. No. 2,929,631 dated Mar. 22, 1960 attached a lenticular lens to the putter itself in order to facilitate a golfer in positioning his eyes directly above the ball.

A putting aid embodying the present invention allows the golfer to determine, by means of a planar reflective member, the position of his eyes in relation to the ball. In addition, a channel design with parallel walls is provided to teach the user to take the clubhead back in a straight line and then to swing through the ball squarely. Finally, by practicing with a retaining bar that can be located at varying distances between the walls, the user is taught the proper length of backswing so as to facilitate accelerating the putter blade on the forward stroke.

Other advantages and goals of the invention will become apparent by reference to the drawings in which.

Figure 1:
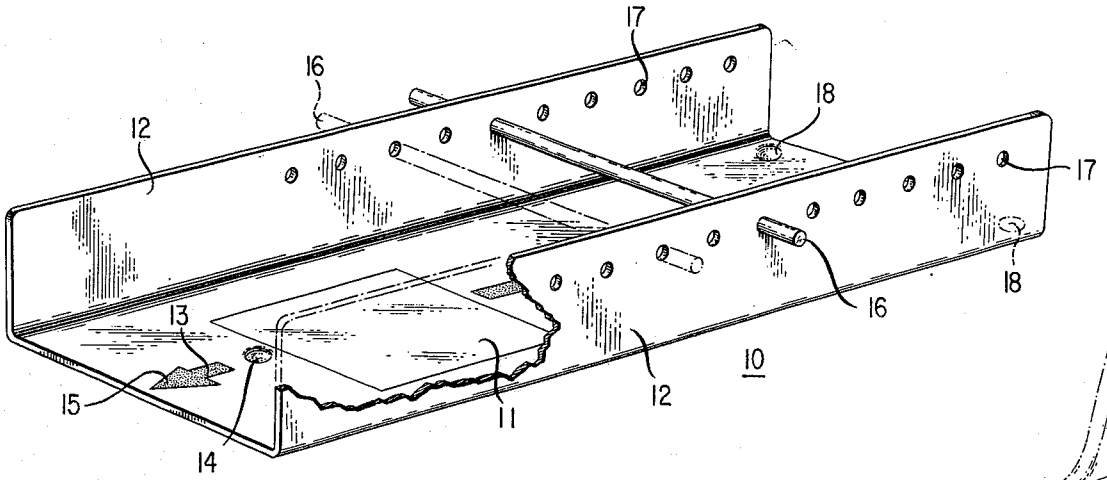
FIG. 1 is a top plan view of a device constructed in accordance with the principles of the invention.
Figure 2:
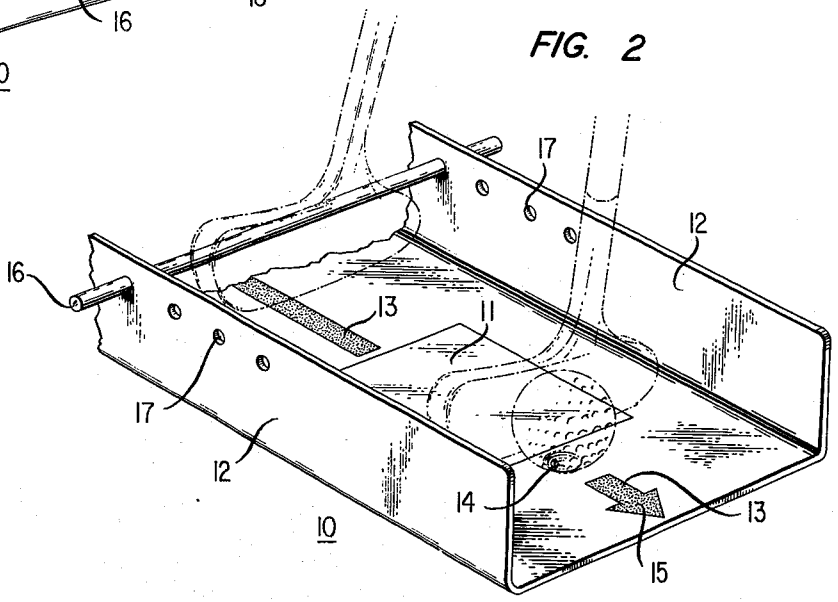
FIG. 2 is a cutaway view to simulate the golf club in its stroking motion with the device.

The longitudinal channel 10 has a non-reflective inner surface except for insert 11 which has a reflective surface. It contains a pair of parallel walls 12 and a visible indicia design 13 which is substantially parallel with the longer walls of said member. Although the indicia 13 may extend the full length of the channel, the objects of the invention will be achieved by a broken line 13 such as shown which extends for a major portion of the channel 10 length but which for simplification of manufacture is not extended through the reflective insert 11. In the illustrative embodiment, the channel 11 is rectangular and 15 inches in length. A dimple 14 is placed 3 inches from the front in order to receive a ball and simulate actual conditions. A dozen inches remain behind the dimple which is about the maximum length stroke ever used in putting.

The interior width of channel 10 in the illustration is 6 inches since the conventional putting club is 4 inches wide, leaving 1 inch on either side of the clubhead before the parallel walls 12 are touched. Having collected many styles of putters, the average width of the blade is 4 inches, with extremes from one of 3½ inches to that of 5 inches. Taking this into account, the channel 10 was made 6 inches wide because any more than an 1¼ inches on each side (with the 3½ inch putter) would destroy the guiding effect of the parallel walls 12 and any less than one-half inch (with the 5 inch blade) would make the swing so restrictive as to make a smooth swing impossible. The maximum guding effect while still allowing a flowing stroke is designed for the 4 inch wide putting club which is the predominant length today. To further develop a repeating, square stroke, the side walls 12 were constructed, in the embodiment, as 2 inches in height to encourage the golfer to sole the club.

The planar reflective member 11 is rectangular and is centrally located just behind the dimple 14 in the disclosed embodiment. In said embodiment, the dimple 14 results in a slight protrusion on the underside of channel 10. Thus, two additional dimples 18 are provided for levelling and stabilization purposes. The channel 10 could be composed of strictly reflective material. However, in the preferred embodiment, the channel, except for insert 11, is annodized green to simulate a putting green and to provide a contrast to the reflective insert 11, thereby encouraging concentrated viewing. The reflective member's straight, front edge provides a reference for aligning the clubhead squarely to the desired line, as indicated by the elongated indicia 13 in FIG. 1. In the illustration, the indicia 13 is provided with an arrow head 15 which if desired may be omitted. This line, 13, indicates the longitudinal center, where the putter blade should be located and over which the eyes should be placed. As the user assumes his address position above the channel, the image of his eyes is visible to him in the reflective insert 11 and is shown in relation to the indicia 13 or the longitudinal center. With the head properly located, the user's eye image will be in line with indicia 11, thus aiding the user in adjusting a proper head position relative to a ball placed on dimple 14.

The retaining member 16 is an elongated rod structure constructed of metal or other suitable material. In the illustrative embodiment, aluminum was chosen since it is light and flexible, not likely to break if the clubhead strikes it when taking an excessive backswing. The retaining bar was made 6½ inches long in the illustration, just a bit longer than the width of the channel. Holes 17 to receive the rod 16 are provided in the channel at various intervals. In the illustrative embodiment, 10 holes are evenly spaced at intervals of 1 inch from 3 to 12 inches behind the dimple 14. This particular spacing was chosen since as the length of putts increase, the length of the swing should increase in intervals of about 1 inch. The walls were built at a height of 2 inches and the bar is suspended at 1½ inches above the base, this bar height prevents the premature lifting of the clubhead which would cause a descending blow rather than a level, solid hit.

In actual use, the rectangular channel 10 is placed on a supporting surface such as a floor or level ground. The ball can be placed in the dimple 14, if so desired.

The putter head is placed in front of the reflective member 11 and square to the front line of said member. The elongated indicia 13 can also be used as a reference for the blade which should be perpendicular to that line.

As the golfer addresses the ball, whether in an upright or crouched position, his eyes are reflected in the lens and appear in relation to the elongated indicia 13. Ideally, the eyes should be in conjunction, completing the break in the arrow, with the indicia being the longitudinal center of the channel 10. If the eyes are inside or outside the line, the clubhead will be drawn inside or outside the line to compensate for the distorted image sent to the brain's eye.

As the club is drawn back, the parallel side walls 12 force the stroke to be square since a putter blade dragged inside or outside the longitudinal center will hit the walls. The arrow 15 is also available to provide a visual guide for insuring that the clubhead is brought straight back and then straight forward on the follow through.

Depending on the length of the putt, the retaining bar 16 can be adjusted to prevent the club from overswinging. The putter must be accelerated on the downstroke, reaching maximum speed at impact in a similar fashion to a plane achieving peak speed just before takeoff. The golfer must learn to groove the backswing, taking it back so many inches for a certain length putt. If the clubhead accelerates, it will remain on the intended line for a longer time thus maximizing the chance for a solid hit.

It will be understood that the foregoing description with the details of exemplary structure is not to be construed in any way to limit the invention, but that modifications may be made thereto without departing from the scope of the invention as set forth in the following claims.

What is claimed is:

1. A longitudinal channel the major portion of whose interior surface is composed of nonreflective material;

the channel having walls on the longer sides;

the channel containing a dimple in which to receive a golf ball;

a reflective area centrally located in said channel and adjacent to said dimple;

the channel having an elongated indicia extending down a major portion of the longitudinal center of the channel;

the width of the channel being slightly greater than the width of a standard putting clubhead;

a retaining bar provided to fit in the parallel walls through various openings and perpendicular to said indicia;

the parts being so constructed and arranged that the reflective area gives an optical indication when the eye of the user is aligned vertically above the longitudinal center, and on line with the center of impact.

2. A golf putting aid comprising;

a rectangular longitudinal member of substantially non-reflective material;

said member having a pair of longitudinal sidewalls;

a dimple on the longitudinal axis of said member for receiving a golf ball;

a centrally located reflective area adjacent to said dimple;

a visible longitudinal indicia extending for a major portion of the length of said channel and equidistant from said sidewalls, and;

a movable rod member mounted in said sidewalls transverse the longitudinal axis of said longitudinal member.

3. The combination in accordance with claim 2 wherein said indicia extends for the length of said longitudinal member except for the longitudinal dimension of said reflective area.

4. The combination in accordance with claim 2 wherein said longitudinal member is slightly wider than the width of the average golf putter;

said average being 4 inches;

wide enough to guide the putter squarely but not so as to restrict the swing;

said width of channel being 6 inches so that putters ranging from 3½ to 5 inch stay square to the line and yet swing freely.

* * * * *